US007354305B2

(12) United States Patent
Sundstrom

(10) Patent No.: US 7,354,305 B2
(45) Date of Patent: Apr. 8, 2008

(54) AREA ARRAY DEVICE TEST ADAPTER

(75) Inventor: Lance L. Sundstrom, Pinellas Park, FL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/152,651

(22) Filed: Jun. 14, 2005

(65) Prior Publication Data

US 2006/0281364 A1 Dec. 14, 2006

(51) Int. Cl.
*H01R 11/00* (2006.01)

(52) U.S. Cl. ..... 439/505; 439/66

(58) Field of Classification Search ..... 439/505, 439/66, 74, 528, 912, 44, 269.1; 324/755, 324/765, 763, 757, 754, 158.1, 785; 174/261
See application file for complete search history.

(56) References Cited

U.S. PATENT DOCUMENTS 5,415,560 A * 5/1995 Balyasny ..... 439/269.1
5,477,160 A * 12/1995 Love ..... 324/755
5,642,055 A * 6/1997 Difrancesco ..... 324/757
5,896,037 A * 4/1999 Kudla et al. ..... 324/755
6,005,403 A * 12/1999 Webster et al. ..... 324/755
6,965,244 B2 * 11/2005 Miller ..... 324/754

* cited by examiner

*Primary Examiner*—Edwin A. Leon
(74) *Attorney, Agent, or Firm*—Fogg & Powers LLC

(57) ABSTRACT

Methods and systems are provided for testing circuits having electronic devices. In one embodiment, an electronic device test adapter comprises a base interface section, at least one test interface section, and at least one flexible section. The base interface section includes a device side attach pad interface and a printed wiring assembly side attach pad interface. The base interface section is adapted to mount onto a printed wiring assembly device. The device side attach pad interface and the printed wiring assembly side attach pad interface are adapted to communicate one or more signals between the electronic device and the printed wiring assembly device. The at least one test interface section includes a testing interface, wherein the base interface section, the at least one flexible section, and the at least one test interface section are adapted to communicate the one or more signals communicated between the electronic device and the printed wiring assembly device to the testing interface.

21 Claims, 17 Drawing Sheets

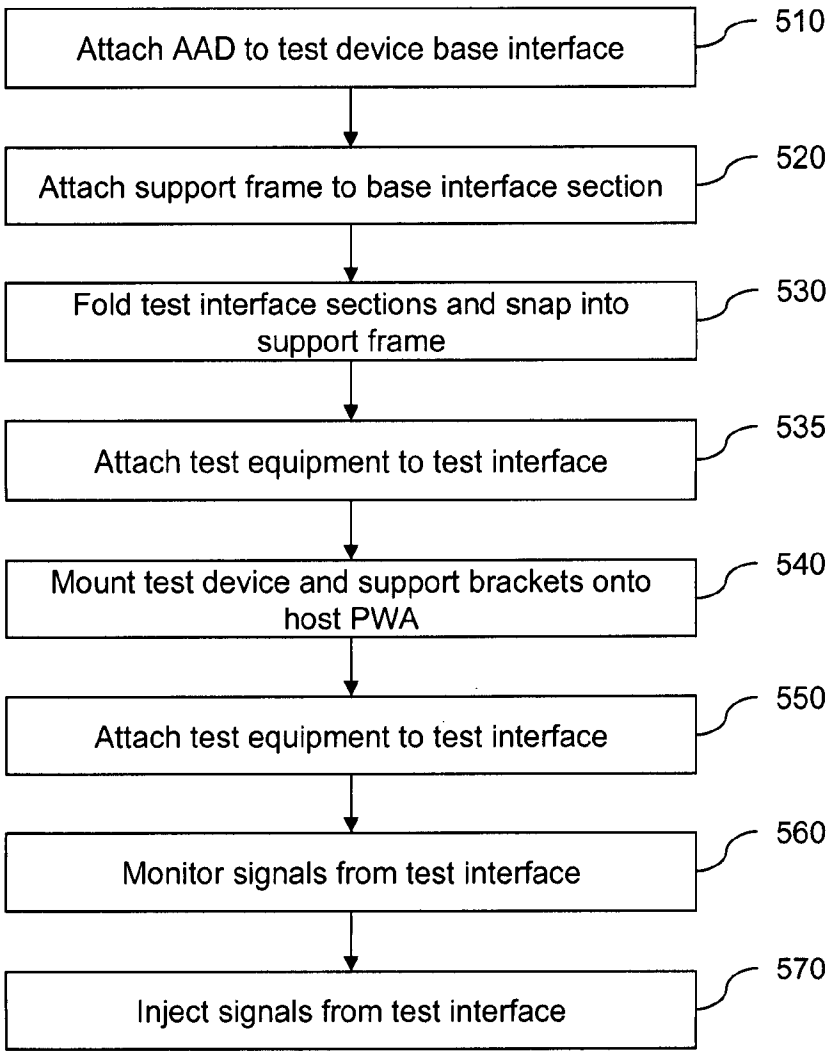
Fig. 5
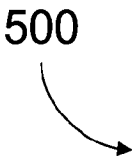

AREA ARRAY DEVICE TEST ADAPTER

TECHNICAL FIELD

The present invention generally relates to the field of semiconductor chip devices and more specifically the testing of prototype electronic devices.

BACKGROUND

One critical stage in the development of new electronic devices, such as those used in-flight by aircraft and spacecraft, is verification of the new device. For design verification, a prototype printed wiring assembly (PWA) should be as close as possible, if not identical, to the production PWA. However, during testing, a prototype PWA must also provide sufficient access to signals in order to verify the proper operation and debug of the electronic devices, such as discrete and integrated circuit (IC) devices, mounted on a printed wiring board (PWB) that is part of the PWA. This access is difficult to obtain where surface mount technology (SMT) area array devices (AADs), such as land grid array (LGA), ball grid array (BGA) or column grid array (CGA) devices or SMT socket-mounted pin grid array (PGA) devices populate the PWB because a significant portion of the input/output (I/O) connections at the interfacial AAD-PWB interface is not exposed and thus are inaccessible to probing. For many applications, such as military and space application, engineers attempt to maximize the density of components mounted on a PWB in order to reduce the volume and weight of the device. For this reason, a PWA may also have SMT devices mounted on both sides of a printed wiring board (PWB), further preventing access to AAD-PWB interface signals from the backside of the PWB.

Typically, testing AAD I/O signals requires placement and routing of additional test points and/or test connectors on the prototype PWA in order to bring out all the signals of the interfacial AAD-PWB interface. This leads to the disadvantage of designing one PWA for use in development testing that is different from a second PWA used for actual production and the addition of test points and/or connectors defeats the space saving advantages of AADs. Besides the extra costs and schedule resources required to produce two PWAs, the use of different PWAs increases the prototype PWA complexity and adds a significant amount of additional trace loading in the prototype PWA that is not present in the production PWA. These disadvantages ultimately make the prototype testing less valid for production design verification (e.g. because of prototype and production PWA timing differences). Boundary scans can provide an indirect indication of the signals at an interfacial interface, but are not useful for troubleshooting signal integrity or timing problems. Finally, conventional AAD test adapters in the art today are much larger than the AADs that they monitor. Thus they require a much larger attach pattern or footprint on the PWA than what the direct-mounted AADs would occupy, and they can overshadow any neighboring devices on the PWA, making the neighboring devices inaccessible for probing.

For the reasons stated above and for other reasons stated below which will become apparent to those skilled in the art upon reading and understanding the specification, there is a need in the art for improved methods and systems for testing prototype PWA populated with SMT AADs devices and other SMT electronic devices.

SUMMARY

The Embodiments of the present invention provide methods and systems for testing AADs, as well as solving other problems and will be understood by reading and studying the following specification.

In one embodiment, an electronic device test adapter is provided. The adapter comprises a base interface section adapted to surface mount on a printed wiring assembly device, the base interface section including a device side attach pad interface and a printed wiring assembly side attach pad interface, the device side attach pad interface and the printed wiring assembly side attach pad interface further adapted to communicate one or more signals between the electronic device and a printed wiring assembly device. The adapter further comprises at least one test interface section including a testing interface and at least one flexible section, wherein the base interface section, the at least one flexible section, and the at least one test interface section are adapted to communicate the one or more signals communicated between the electronic device and the printed wiring assembly device to the testing interface of the at least one test interface.

In another embodiment, a method for testing electronic circuits having one or more electronic devices is provided. The method comprises installing an electronic device into an electronic device test adapter, wherein the electronic device test adapter is adapted to communicate one or more signals between the electronic device and a printed wiring assembly, and communicate the one or more signals to at least one test interface; mounting the electronic device test adapter onto a printed wiring assembly; and monitoring one or more of the signals communicated between the electronic device and the printed wiring assembly from the at least one test interface.

In yet another embodiment, an electronic device test adapter is provided. The adapter comprises an electronic device interface means adapted to surface mount an electronic device, the electronic device base interface means further adapted to communicate one or more signals between the electronic device and a printed wiring assembly; testing interface means; means for communicating the one or more signals communicated between the electronic device and the printed wiring assembly to a plurality of electrical test point means located on the testing interface means; and flexible connecting means adapted to flexibly connect the testing interface means to the electronic device interface means.

DRAWINGS

The present invention can be more easily understood and further advantages and uses thereof more readily apparent, when considered in view of the description of the preferred embodiments and the following figures in which:

FIGS. 1A-C are diagrams illustrating a test adapter of one embodiment of the present invention;

FIG. 5 is a flow chart illustrating a method of one embodiment of the present invention.

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Embodiments of the AAD test adapter of the present invention have advantages over the conventional systems and methods for testing AADs. First, the host PWB footprint of embodiments of the present invention is identical to, or just slightly larger than the footprint of the AAD itself. As such, either the AAD or the AAD test adapter can be mounted to the same host PWB footprint. Embodiments of the AAD test adapter of the present invention do not overshadow adjacent components mounted on the PWB. The trace loading caused by embodiments of the present invention are insignificant. Moreover, the cost, additional schedule and design verification risks associated with using different prototype and production PWA designs are eliminated. Although examples of embodiments of the present invention described in this specification focus on AAD test adapters, embodiments presented include test adapters for any surface mounted electronic device.

Embodiments of the present invention provide the above advantages by inserting a test adapter between the AAD and the AAD-PWB footprint on the host PWB. Embodiments of the present invention allow testing of the entire AAD interface on a production PWA.

Figure 1A:
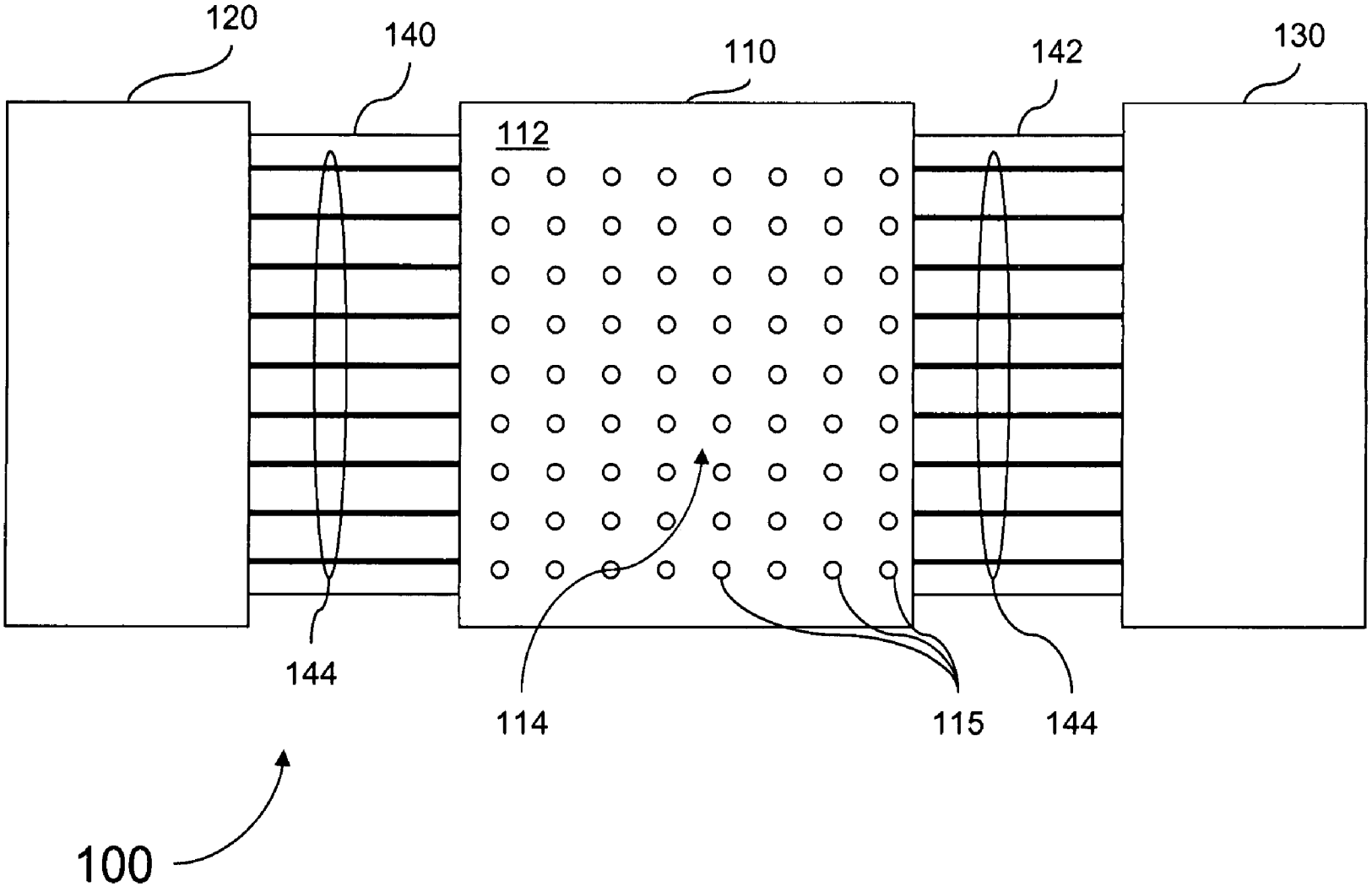
FIGS. 1D and 1E illustrate an AAD and a PWB in combination with a test adapter of one embodiment of the present invention.
FIG. 1F is a diagram illustrating another test adapter of one embodiment of the present invention.
Figure 1B:
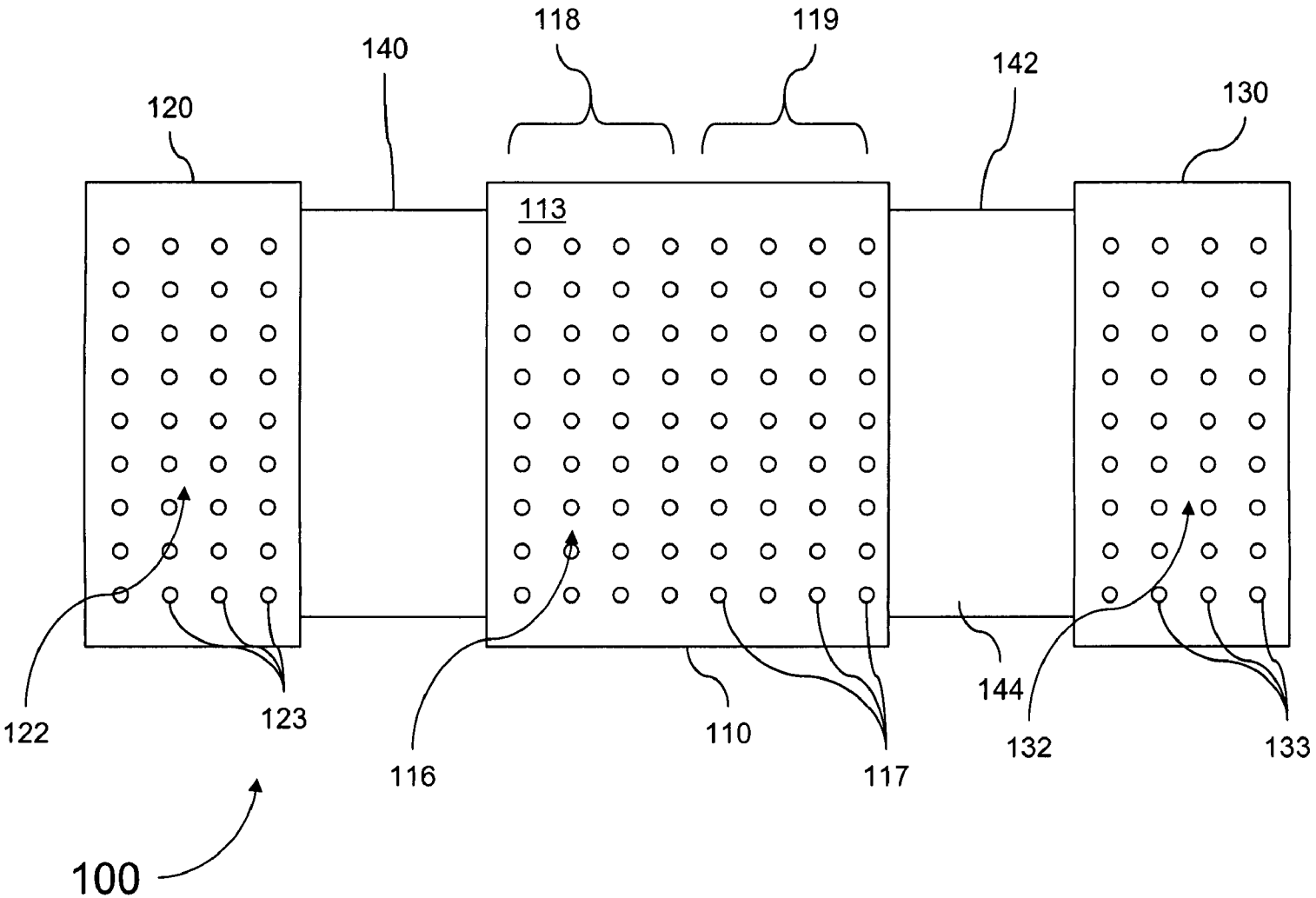
Figure 1C:
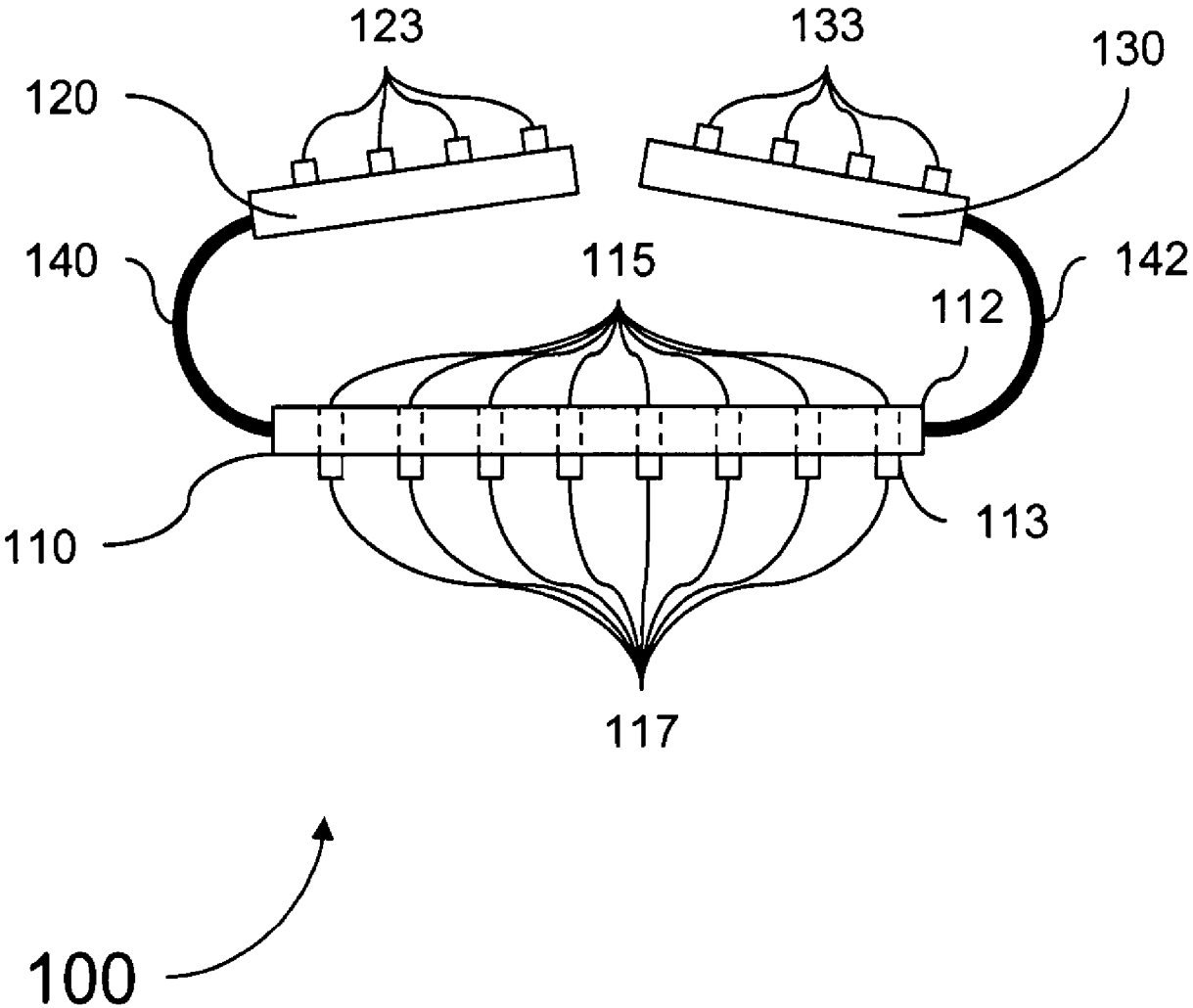

FIGS. 1A, 1B and 1C illustrate top, bottom and folded edge views, respectively, of an AAD test adapter 100 of one embodiment of the present invention. In one embodiment, an AAD test adapter 100 is comprised of a base interface section 110 connected to two test interface sections 120 and 130, by two flexible sections 140 and 142. In one embodiment, as illustrated in FIG. 1A, device side 112 of base interface section 110 includes a device interface 114 comprising a plurality of attach pads, such as attach pads 115, adapted for direct or socket surface mount attachment of an AAD. In one embodiment, as illustrated in FIG. 1B, PWB interface side 113 of base interface section 110 includes a PWB interface 116 comprising a plurality of attach pads, such as attach pads 117, adapted for direct or socket mount attachment of base interface section 110 onto a host PWB. In one embodiment, the arrangement of attach pads for device interface 114 mirror the arrangement of attach pads of PWB interface 116.

In one embodiment each individual attach pad of PWB interface 116 is electrically connected to one attach pad of device interface 114. As also illustrated in FIG. 1B, test interface sections 120 and 130 each comprise a respective testing interface 122 and 132 of respective signal test points, such as test points 123 and 133. In one embodiment, the test points of testing interfaces 122 and 132 are adapted to accommodate surface mount attachment of a pin or socket header. Each test point of testing interface 122 and 132 is electrically connected to an associated attach pad of device interface 114 via flexible sections 140 and 142. In one embodiment, flexible sections 140 and 142, testing interface sections 120 and 130, and base interface section 110, each comprise one or more conductor layers having a plurality of microstrip traces 144. Each test point of testing interface 122 and 132 is electrically connected to an associated attach pad of device interface 114 via one of the plurality of microstrip traces 144. In one embodiment, the one or more conductor layers further provide one or more of a ground plane and a power plane. In one embodiment, microstrip traces 144 are adapted to maintain a characteristic 50 ohm trace resistance. A surface microstrip trace requires thinner dielectric layers than a buried stripline trace of the same impedance. To reduce overall thickness and increase flexibility, in one embodiment, flexible sections 140 and 142 are comprised of the minimum number of microstrip traces 144 and layers necessary for signal routing, trace impedance and trace cross-talk control. Flexible sections 140 and 142 having two conductor layers, each comprised of a reference surface power, or ground, or split power/ground plane on one side and 5 mil surface microstrip traces and spaces on the other side, can accommodate five signal rows of an area array with a 50 mil grid. Flexible sections 140 and 142 having three conductor layers, each comprised of 5 mil surface microstrip traces and spaces on both sides separated by a central reference ground and power, or split power/ground plane, can accommodate ten signal rows of an area array with a 50 mil grid. In one embodiment, in order to minimize the signal path length, attach pads from a first section 118 of base interface section 110 are connected to testing interface 122 test points while attach pads from a second section 119 of base interface section 110 are connected to testing interface 132 test points.

As illustrated in FIG. 1C, in one embodiment, flexible sections 140 and 142 allow test interface sections 120 and 130 to fold into a position above base interface section 110 thus providing convenient access to testing interfaces 122 and 132. FIG. 1F illustrates an alternate embodiment 170 of the present invention. This embodiment operates as described above for embodiment 100, except that connections are routed through a single flexible section 176 connecting a plurality of AAD device attach pads (not shown) and attach pads 178 located on base interface section 172 to a plurality of test points 180 on test interface section 174.

Figure 1D:
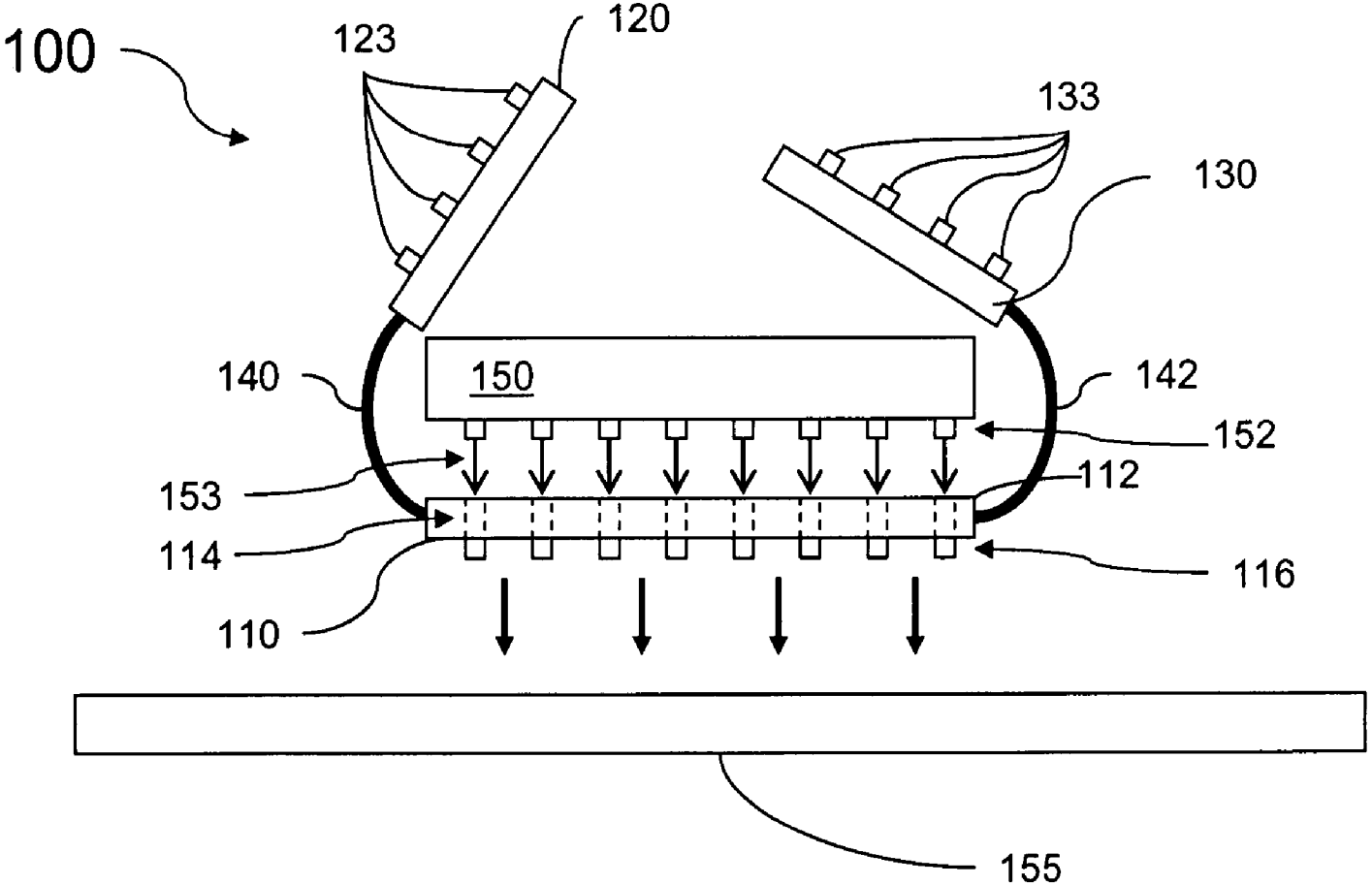
Figure 1E:
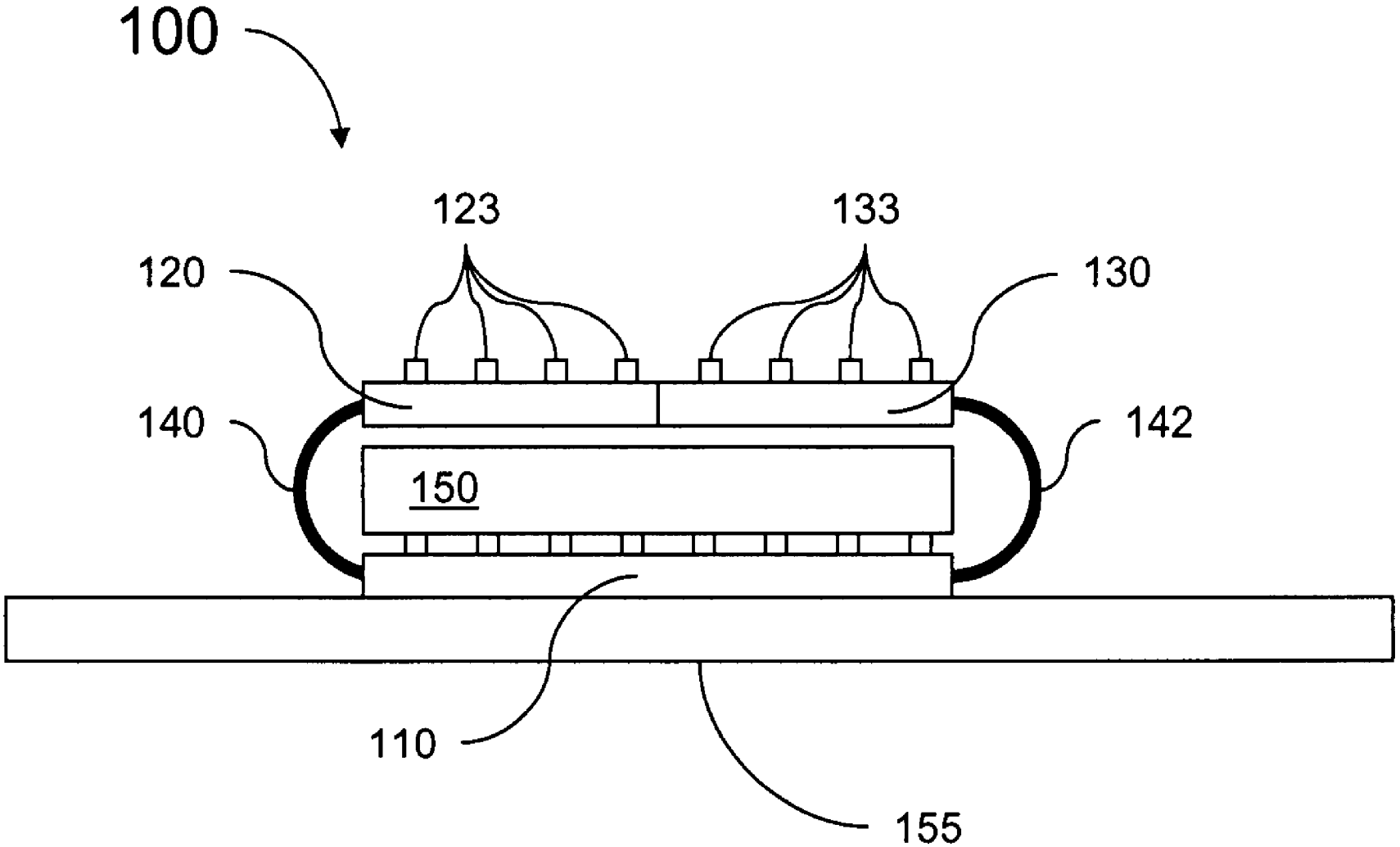
Figure 1F:
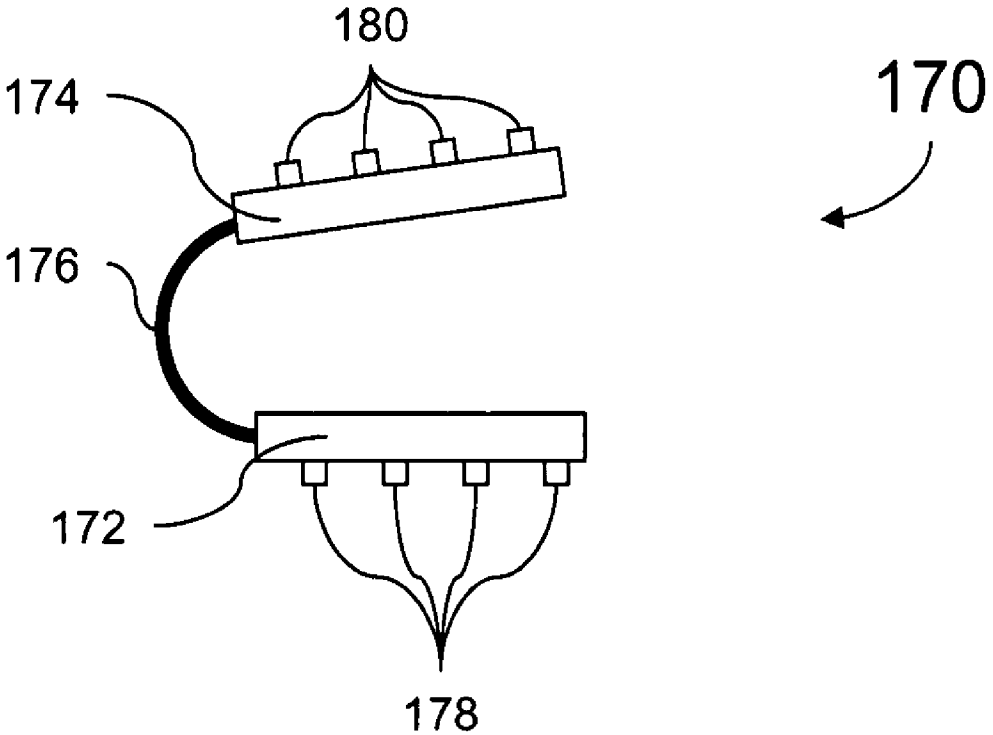

FIGS. 1D and 1E illustrate one embodiment of using AAD test adapter 100 in combination with an AAD 150 for testing with PWB 155. AAD 150 is direct or socket surface-mount attached to inserted into the device side 112 of the base interface section 110 of AAD test adapter 100 wherein the arrangement of attach pads of device interface 114 mirror the arrangement of AAD 150 attach pads 152. Each attach pad 152 aligns with and electrically couple to (shown generally at 153) one or more device interface 114 attach pads. Once AAD 150 is attached to base interface section 110, AAD test adapter 100 is attached to an AAD-PWA attach pad interface located on PWA 155 which is adapted for use with AAD 150. Connections between PWA 155 and AAD 150 can then be monitored by connecting test probes, or connectors, or cables to one or more testing interface 122 and 132 test points. In one embodiment, test interface sections 120 and 130 may be bonded directly to the top of AAD 150.

Figure 2A:
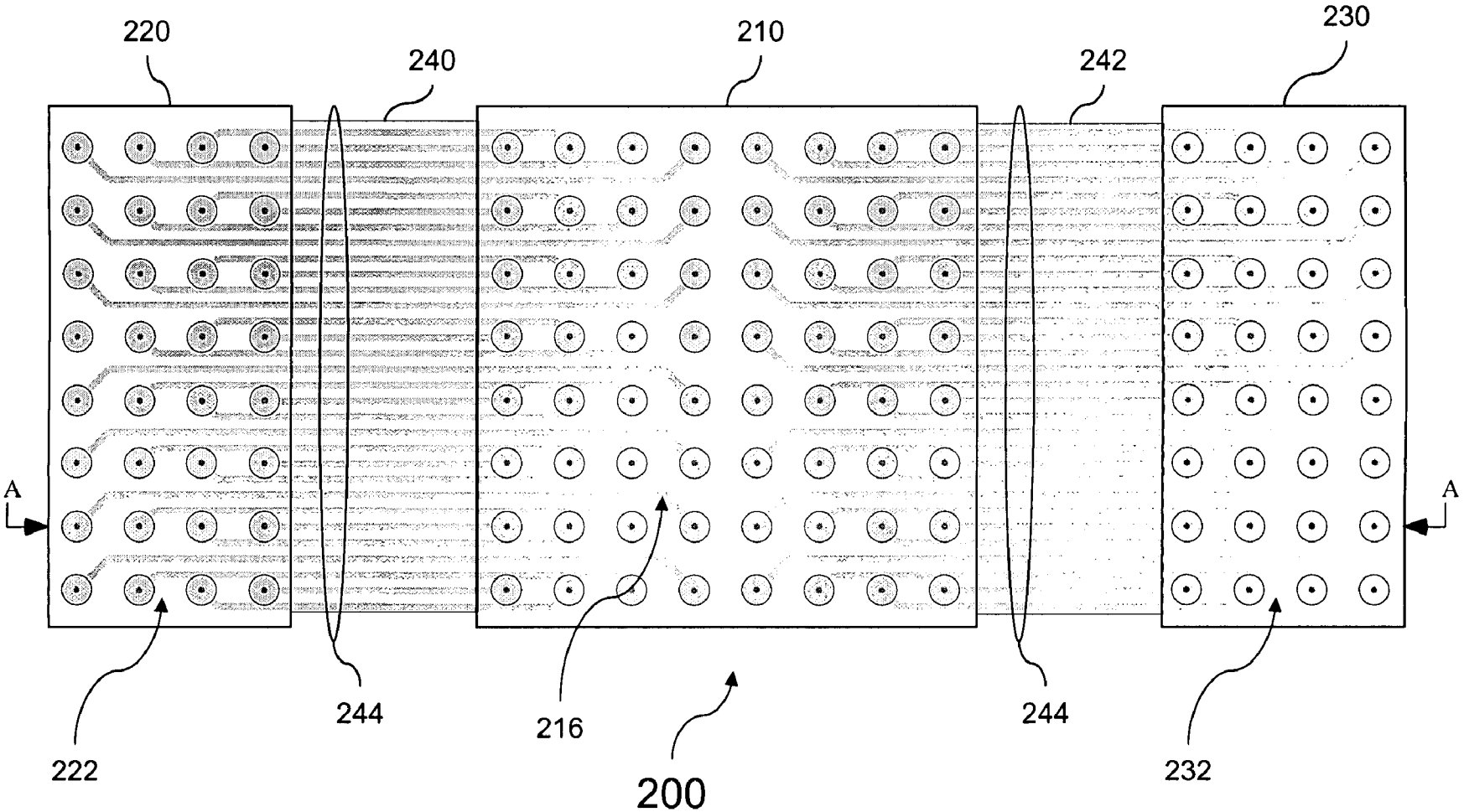
FIGS. 2A and 2B are a transparent view and cross section view of a rigid-flex PWB test adapter of one embodiment of the present invention.
Figure 2B:
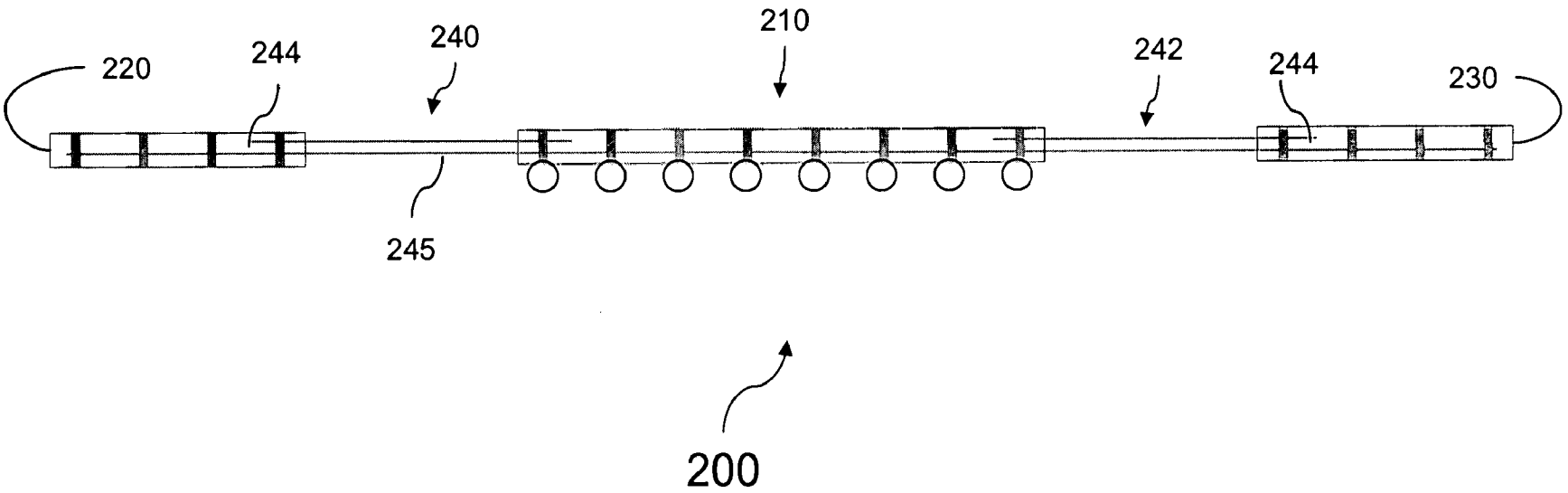

FIG. 2A is a transparent view illustrating an AAD test adapter 200 comprising the elements of AAD test adapter 100, constructed from a multilayer rigid-flex PWB. FIG. 2B provides an A-A cross section view of AAD test adapter 200. Base interface section 210 and test interface sections 220 and 230 comprise rigid PWB sections of the multilayer rigid-flex PWB and flexible sections 240 and 242 are flex PWB sections of the multilayer rigid-flex PWB. Test pads of testing interface 222 and 232 are electrically connected to an associated attach pad of PWB interface 216 via one of a plurality of microstrip traces 244. In one embodiment, AAD test adapter 200 further comprises one or more additional layers 245 comprising one or more of a ground plane, power plane, or split power/ground plane. In one embodiment, one or more pads may be connected to the power or ground portions of the power, ground, or split power/ground planes rather than connected to other pads via microstrip traces 244.

In one embodiment, the AAD test device further comprises a support frame 300 in order to provide mechanical support of test interface sections 120 and 130. Support frame 300 provides strain relief for the interfacial connections between the PWB interface 116 of base interface section 110 and a host PWB 155 from stresses exerted by any test cables that may be attached to the test points of testing interfaces 122 and 132, when support frame 300 is bonded or soldered to host PWB 155.

In one embodiment, an ADD test adapter is held in place by a support frame in order to physically support the test interface sections, provide strain relief to the interfacial connections between the PWB interface 116 of AAD test adapter base interface section 110 when probing with, or attaching one or more test cables, and maintain a tight bend on the flexible sections in order to minimize the overall size of the AAD test adapter when attached onto a host PWB 155.

Figure 3B:
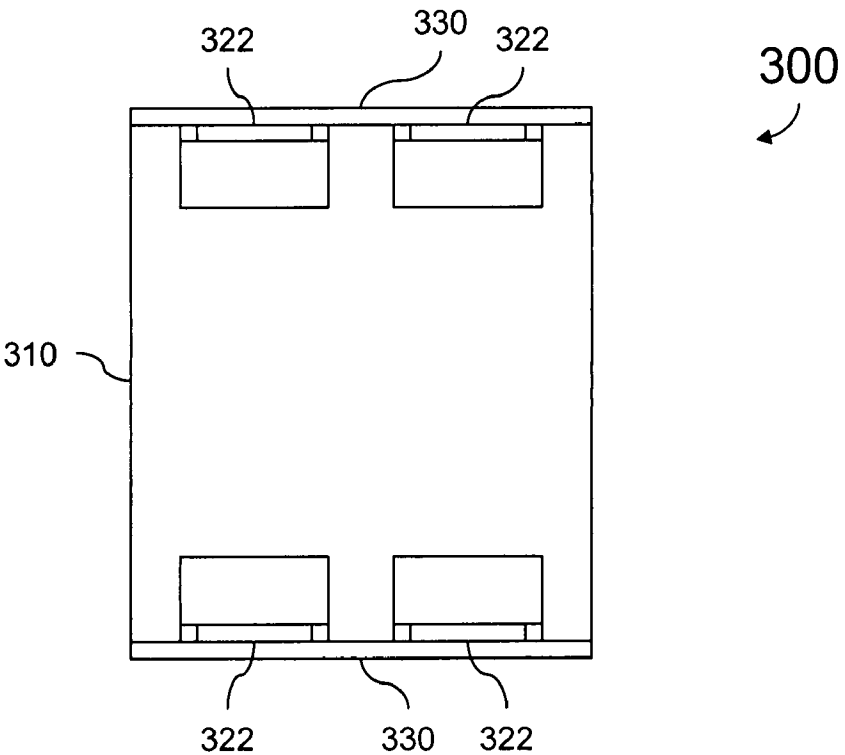
FIGS. 3A, 3B, 3C, 3D illustrate a support frame of one embodiment of the present invention.
Figure 3A:
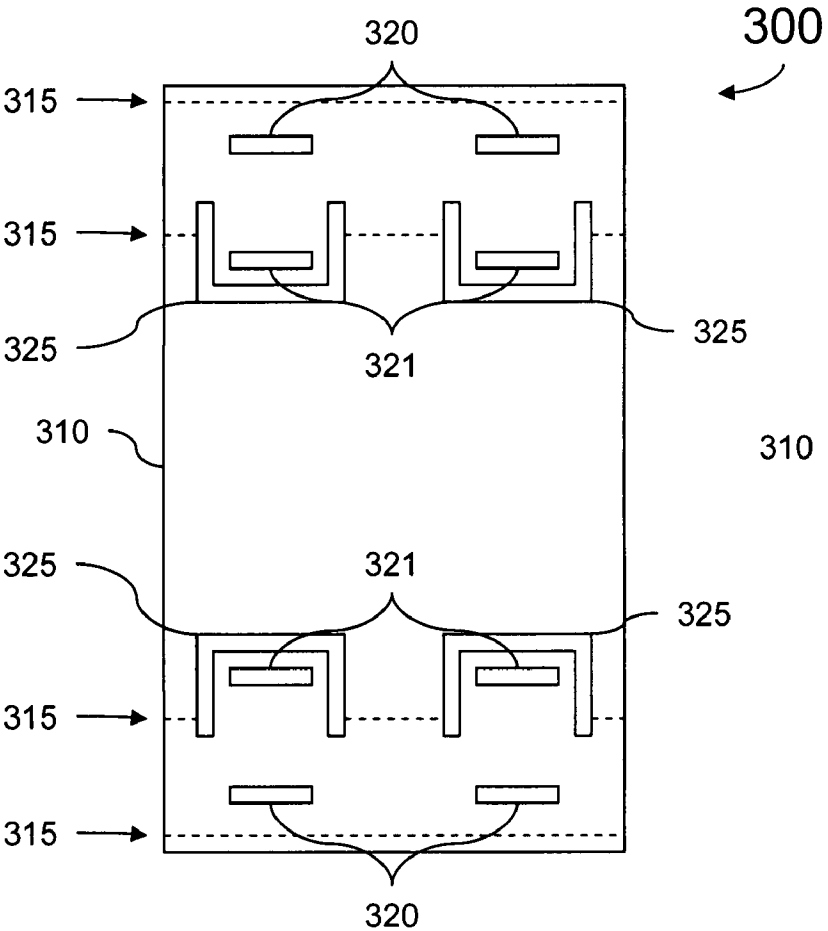
Figure 4A:
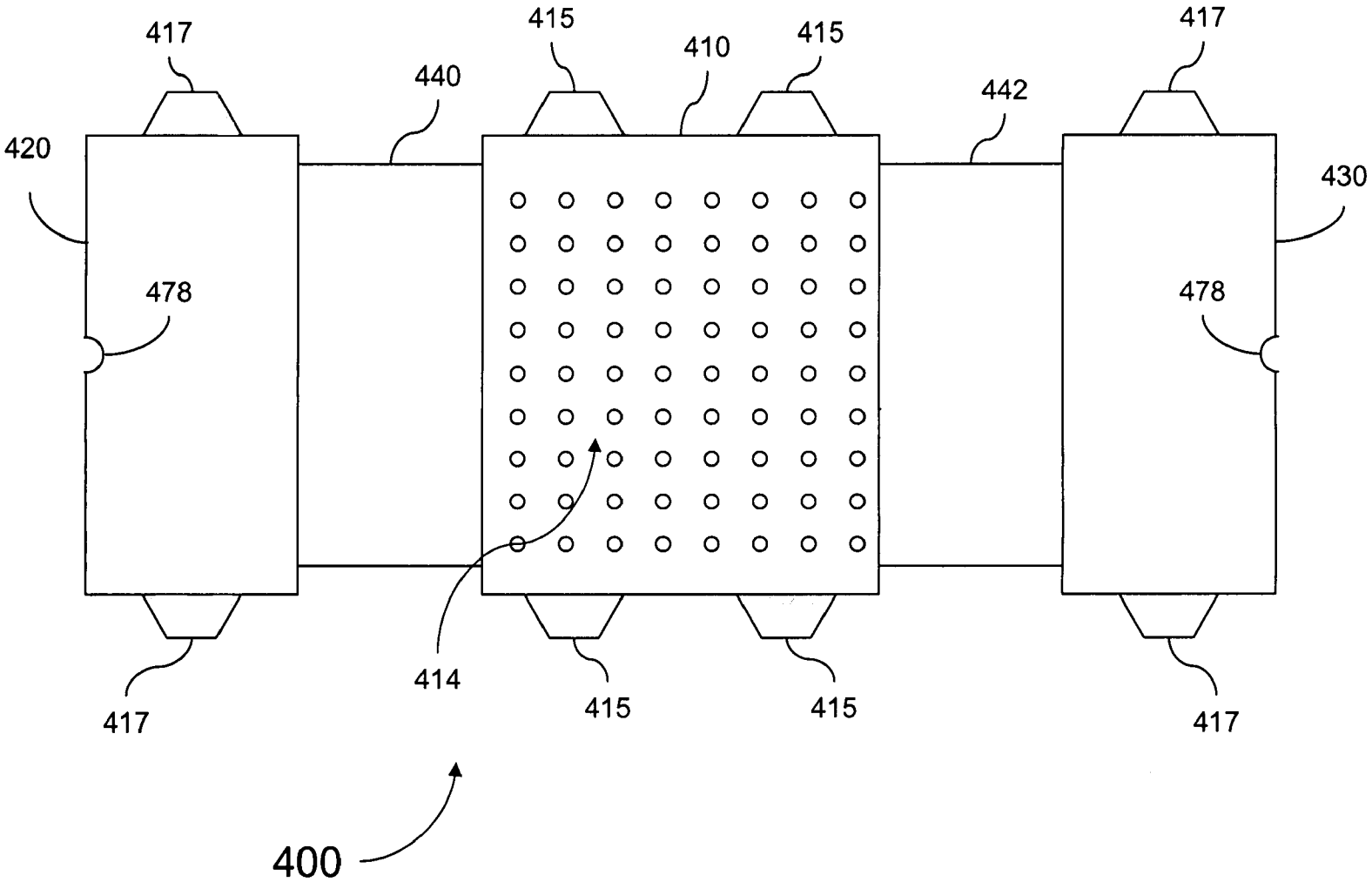
FIGS. 4A, 4B, 4C, 4D, 4E and 4F illustrate installation of an AAD into a PWB in combination with a test adapter and support frame of one embodiment of the present invention.
Figure 4B:
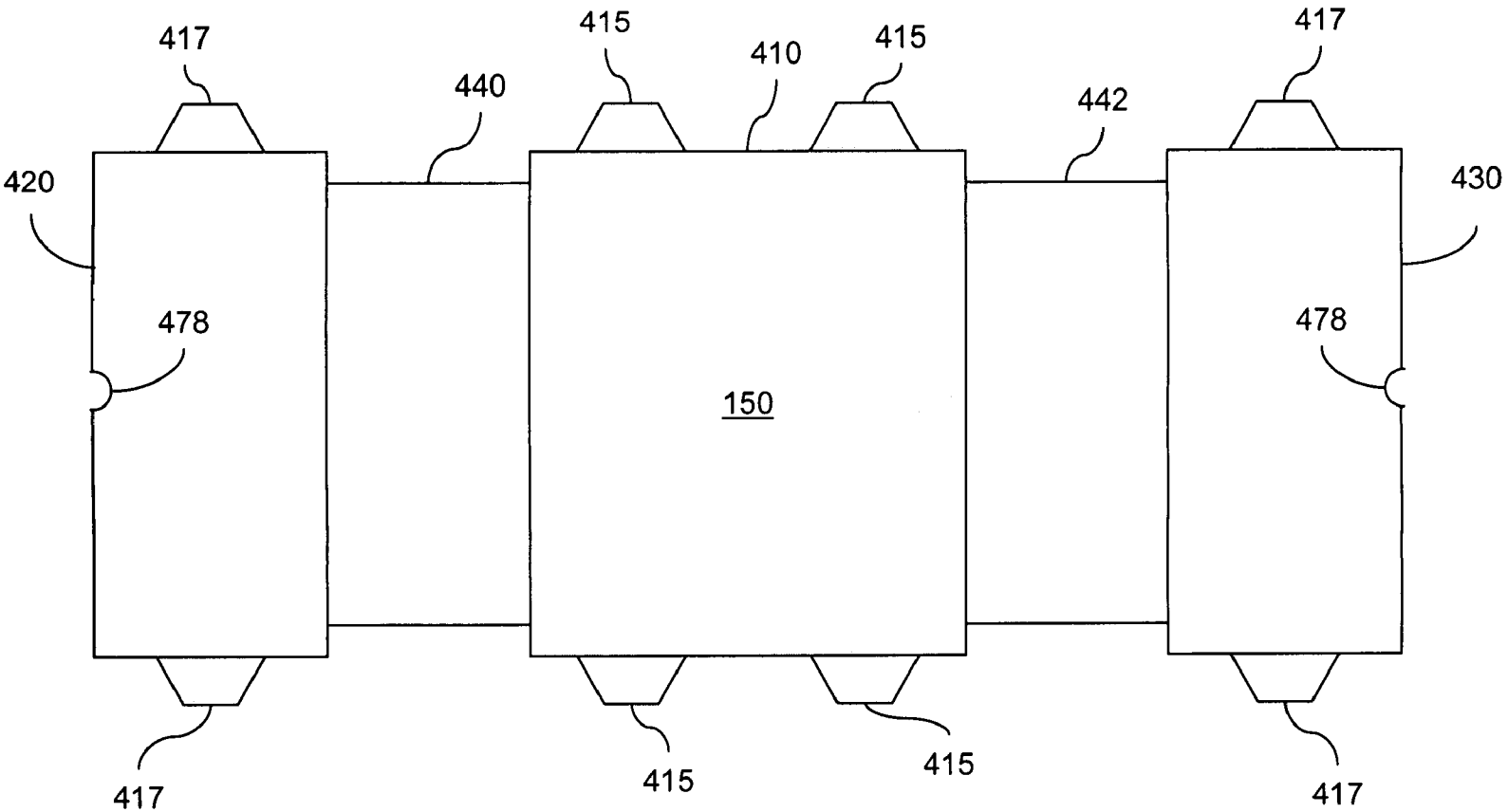
Figure 4C:
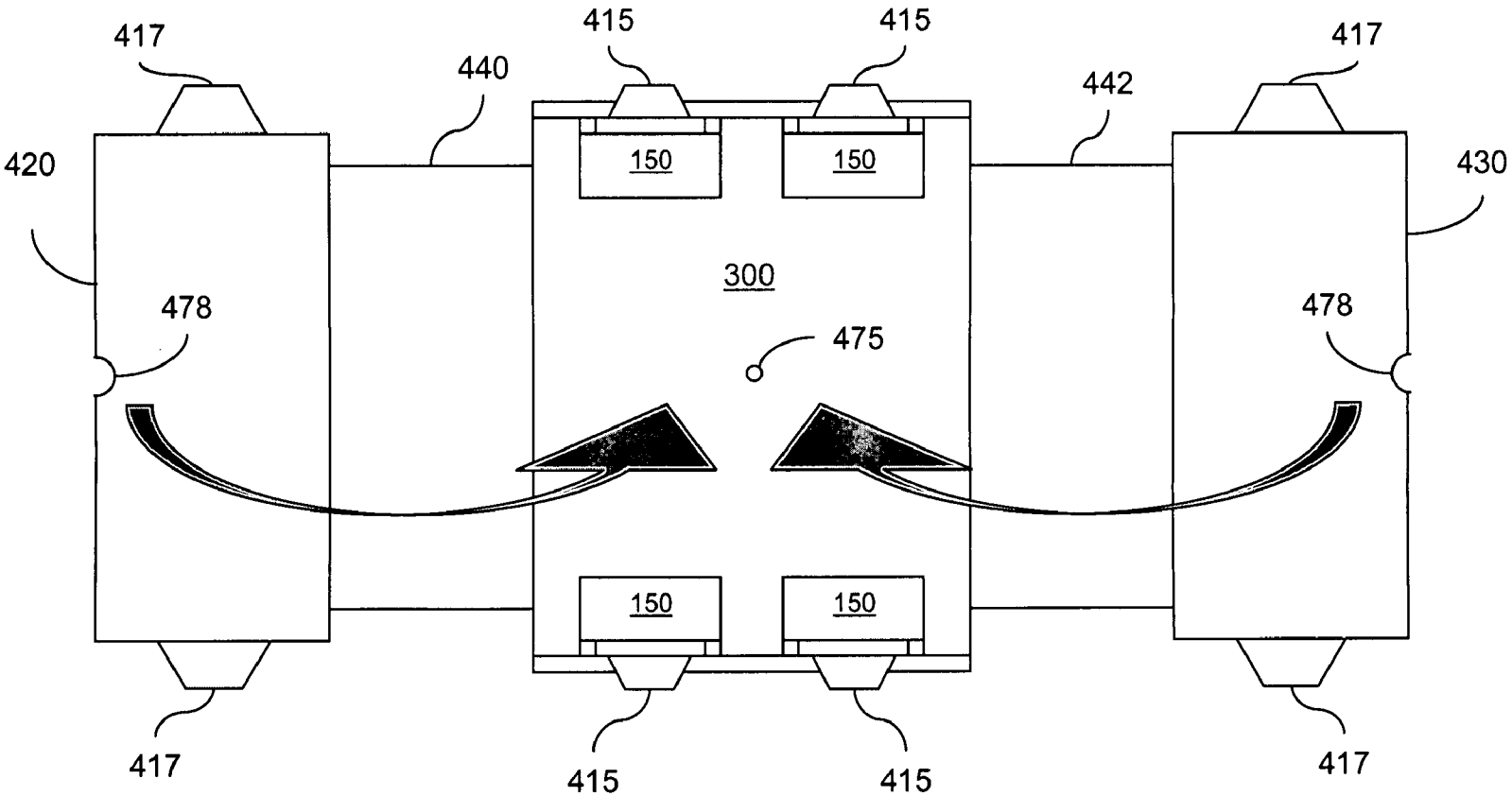
Figure 4D:
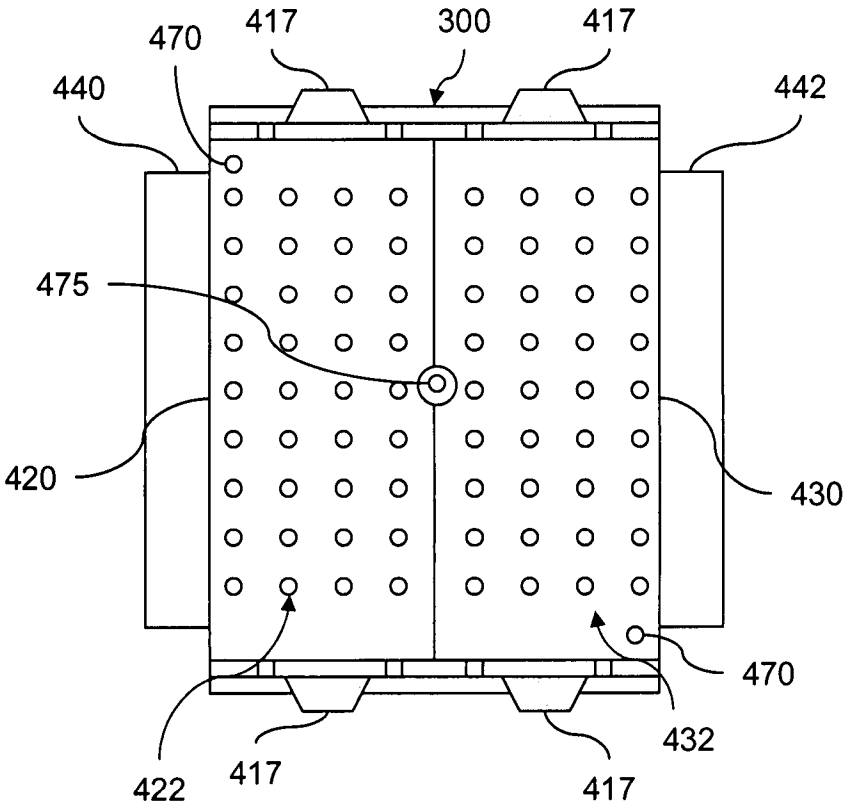
Figure 4E:
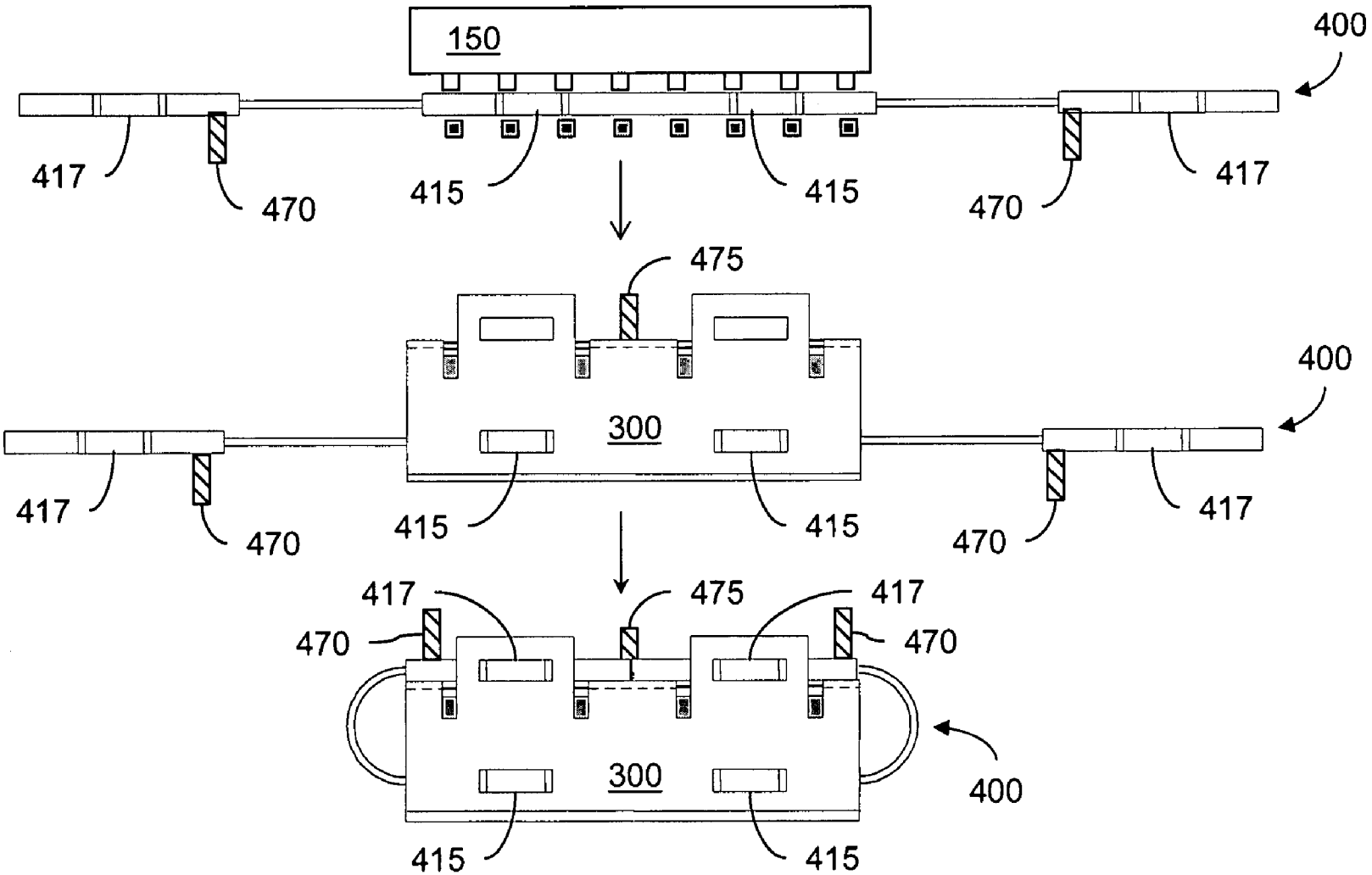
Figure 4F:
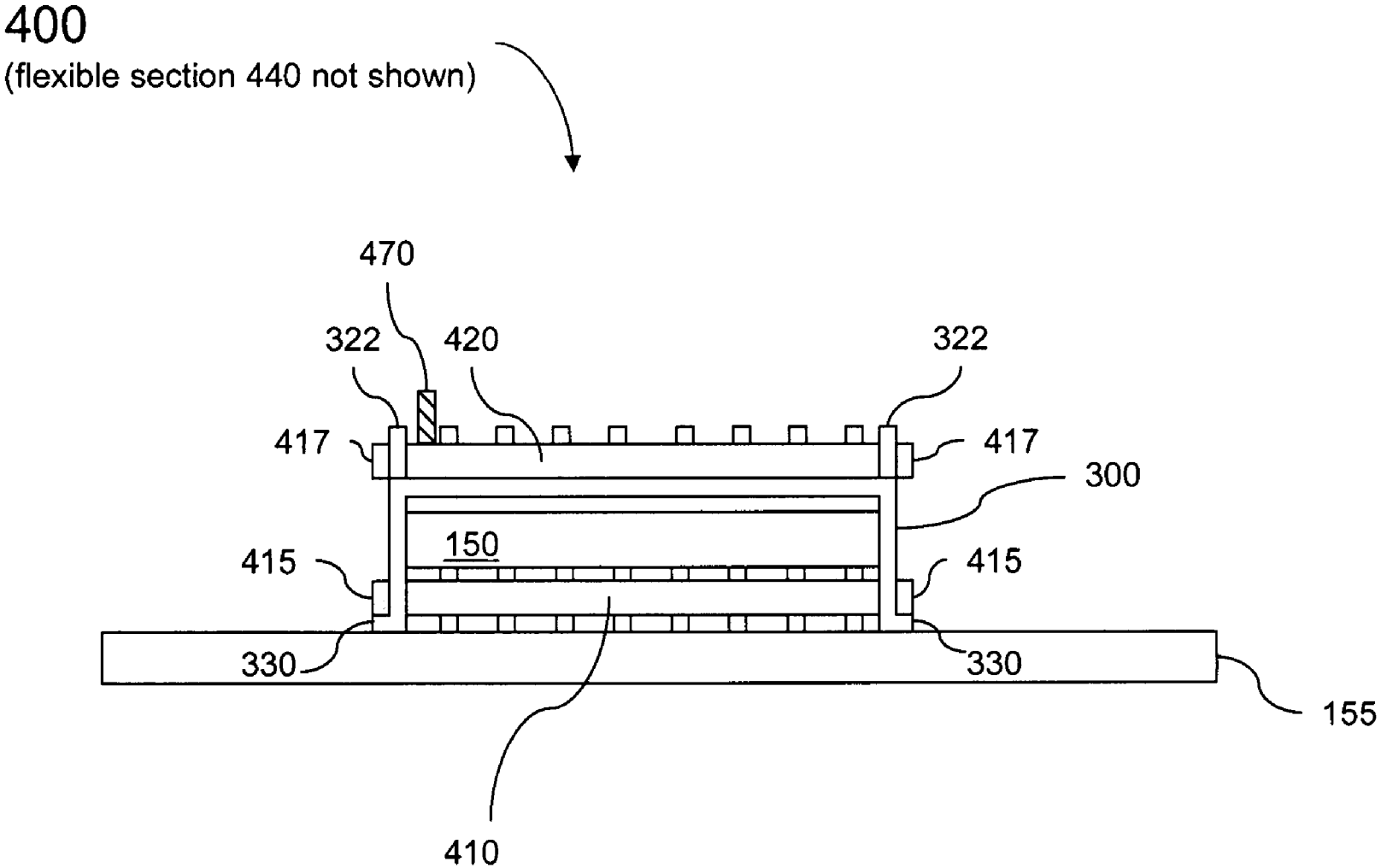

In one embodiment, a support frame 300 is constructed to support an AAD test adapter modified for use with the support frame. FIG. 4A illustrates an AAD test adapter 400 comprising the elements of AAD test adapter 100, wherein test interface section 420 and 430 further comprise tabs 417, and wherein base interface section 410 further comprises tabs 415. In one embodiment, a support frame 300 is formed from by punching base interface section slots 320, test interface section slots 321, and slots 325 into a thin metal plate 310 as illustrated in FIG. 3A. Metal plate 310 is then folded along fold lines 315 to form the support bracket as illustrated in FIGS. 3B (top view), 3C (first side view), and 3D (second side view). FIGS. 4B-D illustrate assembling support frame 300, and AAD test adapter 400 together with an AAD 150. As illustrated in FIG. 4B, an AAD 150 is attached onto the device interface 414 of base interface section 410. Support flame 300 is then installed over AAD 150 wherein tabs 415 of base interface section 410 snap into base interface section slots 320 of support frame 300, as illustrated in FIG. 4C. Test interface sections 420 and 430 then fold together so that tabs 417 snap into test interface section slots 321 located in snap tabs 322 of support frame 300 as illustrated in FIG. 4D. FIG. 4E provides a side edge view illustrating the assembly of AAD 150, AAD test adapter 400 and support frame 300 as described in FIGS. 4B-D. FIG. 4F illustrates a first side view AAD test adapter 400 and support frame 300 fully assembled, with AAD 150 attached, and mounted into PWB 155 (flexible sections not shown). In one embodiment, feet 330 of support frame 300 are soldered onto mating solder attach pads on host PWA 155. In one embodiment, feet 330 of support frame 300 are bonded to host PWB 155 by an epoxy adhesive. If feet 330 of support frame 300 are soldered to host PWA 155, host PWA 155 must be adapted with solder attach pads.

In one embodiment, one or more threaded studs 470 are integrated into the respective test interface 422 and 432 sides of test interface sections 420 and 430 to assist in applying insertion and extraction forces (e.g. with a thumb screw) to install a test cable onto AAD test adapter 400. In another embodiment, support frame 300 is adapted with one or more threaded studs 475. In one embodiment, the one or more threaded studs are positioned along the centerline between the folded test interface sections 420 and 430. Test interface sections 420 and 430 are adapted to provide clearance for the one or more threaded studs 475 via one or more clearance holes 478. This provides strain relief for the interfacial connections between test interface sections 420 and 430 and a bolted on test connector.

Figure 3D:
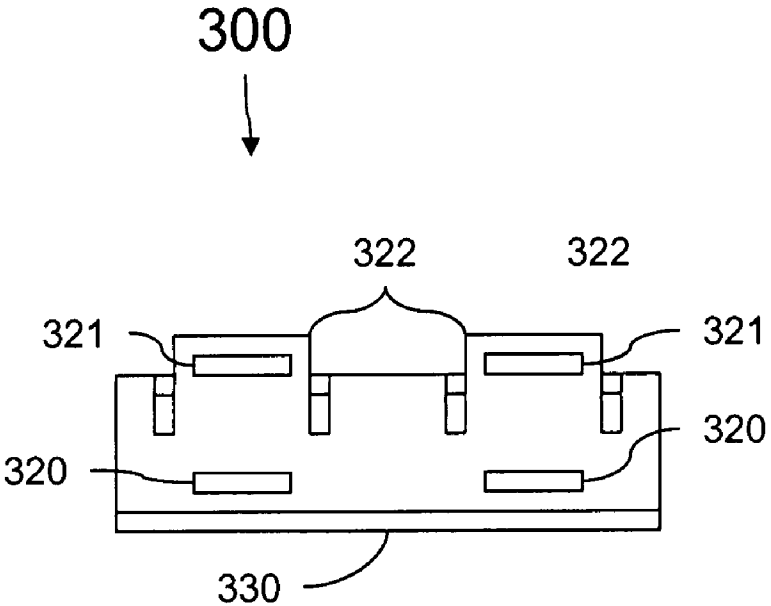
Figure 3C:
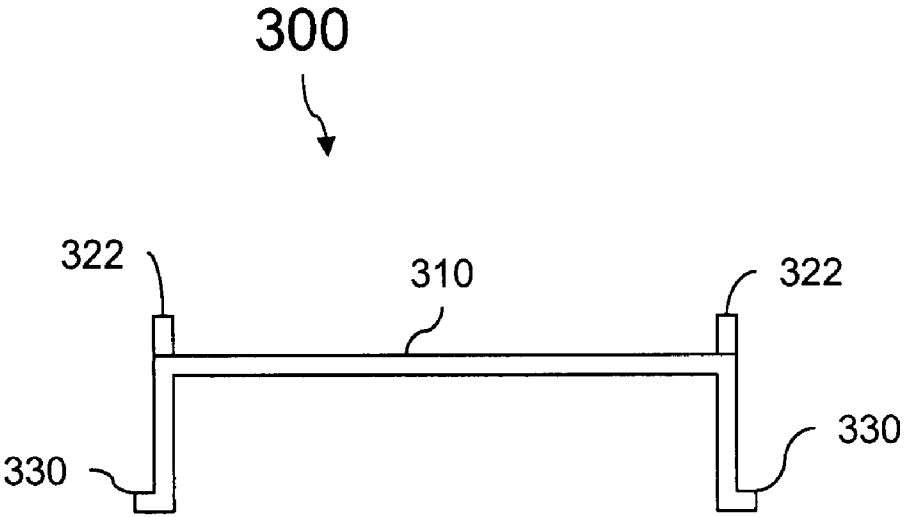

FIG. 5 is a flow chart illustrating a method 500 of one embodiment of the present invention using AAD test adapter 400 of FIG. 4A and support frame 300 as shown in FIGS. 3B-D. The method first comprises surface mounting an AAD to the device interface 414 of base interface section 410 so that the attach pads of the AAD align with the attach pads of device interface 414 (510). Support frame 500 is installed onto base interface section 410 (520) by snapping tabs 415 into slots 320 as shown in FIG. 4C. Test interface sections 420 and 430 are folded into position directly on top of the AAD, as shown in FIG. 4C, and snapped into place by snapping tabs 417 into slots 321 of snap tabs 322 (530) as shown in FIG. 4D. AAD test adapter 400 and support frame 300 are then surface-mounted into a host PWB 155 (540). In one embodiment, feet 330 of support frame 300 are attached the host PWB 155 using one or more of solder, epoxy adhesive or other adhesive. If feet 330 of support frame 300 are soldered to host PWB 155, host PWB 155 must be adapted with solder attach pads. If feet 330 of support frame 300 are bounded to host PWB 155 with an adhesive, then solder attach pads are not required. One or more test equipment, such as, but not limited to, test connectors, meters, oscilloscopes, and other diagnostic equipment may be attached to testing points on test interfaces 422 and 432 either before (535) or after (550) AAD test adapter 400 and support frame 300 are surface-mounted into host PWB 155 (540). One or more signals communicated between the AAD and host PWB 155 are monitored from the testing interface (560). In one embodiment, test equipment connected to test interface section 420 and 430 can be used to inject one or more test signals into the ADD, the PWB, or both (570).

In some applications, an AAD such as a microprocessor may generate sufficient heat such that mounting a heat sink is required for continued operation of the AAD. To accommodate such applications, heat sinking can be accomplished by thermal conduction to support frame 300 and then to PWB ground planes and/or cooling fins. This can be done by creating one or more low thermal impedance paths from the AAD through support frame 300 to the ground plane(s) of the PWB. For example, this can be done by compressing a thermally conductive material between the top of the AAD and the bottom of the horizontal portion of the support frame during snap assembly, thus providing a low thermal impedance path between the top of the AAD and the support bracket. Further, the tab extensions of the base interface section (i.e. tabs 415) could be metalized, connected to an internal ground plane (within the one or more conductor layers) with one or more thru-vias and soldered to support frame 300 after snap assembly. This provides low thermal impedance paths from the bottom ground connections of the AAD through the base interface section to the support frame. Support frame is then soldered to attach pads on the PWB with multiple vias to one or more PWB ground planes. In one embodiment, a fin assembly can be attached (e.g. soldered) to the top of support frame 300 to provide convection cooling.

One skilled in the art upon reading this specification would appreciate that embodiments of the present invention are not limited to area array devices but that the embodiments presented are applicable to any other surface mounted electronic device where one desires to monitor the electronic device interface signals without increasing the area footprint used on the host PWA.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. An electronic device test adapter, the adapter comprising:

a base interface section configured to surface mount on a printed wiring assembly device, the base interface section including a device side attach pad interface and a printed wiring assembly side attach pad interface, the device side attach pad interface and the printed wiring assembly side attach pad interface further configured to communicate one or more signals between the electronic device and a printed wiring assembly device;

at least one test interface section including a testing interface; and at least one flexible section, wherein the base interface section, the at least one flexible section, and the at least one test interface section are configured to communicate the one or more signals communicated between the electronic device and the printed wiring assembly device to the testing interface of the at least one test interface;

a support frame configured to support the at least one test interface section and provide relief from stresses cause by one or more test devices attached to the testing interface of the at least one test interface section;

wherein the support frame further comprises:

a bracket having one or more base interface section slots and one or more test interface section slots;

wherein the base interface section further includes one or more tabs adapted to snap into the one or more base interface section slots;

wherein the test interface section includes one or more tabs adapted to snap into the one or more test interface section slots;

wherein the bracket is adapted to attach to the base interface section by snapping the one or more tabs of the base interface section into the one or more base interface section slots; and wherein bracket is further adapted to support the at least one test interface section in position above the electronic device by snapping the one or more tabs of the test interface section into the one or more test interface section slots.

2. The adapter of claim 1, wherein the testing interface of the at least one test interface section is configured to accommodate a surface mount attachment of at least one of a pin header and a socket header test connector.

3. The adapter of claim 1, wherein the support frame further comprises at least one threaded stud.

4. The adapter of claim 1, wherein the support frame is secured to the printed wiring assembly device by one or more of a high temperature solder bond and an adhesive bond.

5. The adapter of claim 1, wherein the at least one test interface section further comprises at least one threaded stud.

6. The adapter of claim 1, wherein the base interface section, the at least one flexible section and the at least one test interface section are comprised of one or more multilayer rigid-flex printed wiring boards.

7. The adapter of claim 1, wherein the electronic device is an area array device.

8. The adapter of claim 7, wherein the area array device is one of a land grid array device, a ball grid array device, a column grid array device, and a pin grid array device.

9. The adapter of claim 1, wherein the device side attach pad interface further comprises a plurality of attach pads, wherein the printed wiring assembly side attach pad interface further comprises a plurality of attach pads, wherein each of the plurality of attach pads of the device side attach pad interface is electrically connected to an associated attach pad of the plurality of attach pads of the printed wiring assembly side attach pad interface.

10. The adapter of claim of claim 9, wherein the testing interface of the at least one test interface sections comprises a plurality of test points each electrically connected to an associated attach pad of the device side attach pad interface and an associated attach pad of the printed wiring assembly side attach pad interface, wherein the plurality of test points are configured to accommodate a surface mount attachment of at least one of a pin header and a socket header test connector.

11. The adapter of claim 1, wherein the base interface section, the at least one flexible section, and the at least one test interface section transmit the one or more signals communicated between the electronic device and the printed wiring assembly device to the testing interface of the at least one test interface via one or more microstrip traces.

12. The adapter of claim 11, wherein the microstrip traces are configured to maintain a characteristic 50 ohm trace resistance.

13. The adapter of claim 11, wherein the base interface section, the at least one flexible section, and the at least one test interface section further comprise one or more of a reference power plane and a reference ground plane.

14. A rigid-flex printed wiring board comprising:

a base rigid interface section configured to surface mount on a host printed wiring board, the base rigid interface section including a device side attach pad interface and a host printed wiring board side attach pad interface, the device side attach pad interface and the host printed wiring board side attach pad interface further configured to communicate one or more signals between a surface mount technology electronic device and the host printed wiring board;

at least one rigid test interface section including a testing interface;

at least one flexible section;

wherein the base rigid interface section, the at least one flexible section, and the at least one rigid test interface section are configured to transmit the one or more signals communicated between the surface mount technology electronic device and the host printed wiring board to the testing interface of the at least one rigid test interface via one or more microstrip traces; and a support frame configured to support the at least one rigid test interface section and provide relief from stresses cause by one or more test devices attached to the testing interface of the at least one rigid test interface section;

wherein the support frame further comprises one or more base interface section slots and one or more test interface section slots;

wherein the base rigid interface section includes one or more tabs adapted to snap into the one or more base interface section slots; and wherein the rigid test interface section includes one or more tabs adapted to snap into the one or more test interface section slots.

15. The rigid-flex printed wiring board of claim 14, wherein the testing interface of the at least one rigid test interface section is configured to accommodate attachment of at least one of a pin header and a socket header test connector.

16. The rigid-flex printed wiring board of claim 14, further comprising one or more of a reference power plane and a reference ground plane.

17. The rigid-flex printed wiring board of claim 14, wherein the surface mount technology electronic device is an area array device.

18. The rigid-flex printed wiring board of claim 17, wherein the area array device is one of a land grid array device, a ball grid array device, a column grid array device, and a pin grid array device.

19. The rigid-flex printed wiring board of claim 14, wherein the device side attach pad interface further comprises a plurality of attach pads, wherein the host printed wiring board side attach pad interface further comprises a plurality of attach pads, wherein each of the plurality of attach pads of the device side attach pad interface is electrically connected to an associated attach pad of the plurality of attach pads of the host printed wiring board side attach pad interface.

20. The rigid-flex printed wiring board of claim 19, wherein the testing interface of the at least one rigid test interface sections comprises a plurality of signal test points each electrically connected to an associated attach pad of the device side attach pad interface and an associated attach pad of the host printed wiring board side attach pad interface.

21. The rigid-flex printed wiring board of claim 20, wherein the plurality of signal test points are configured to accommodate attachment of at least one of a pin header and a socket header test connector.

* * * * *